US008764277B2

(12) United States Patent
Whitney et al.

(10) Patent No.: US 8,764,277 B2
(45) Date of Patent: Jul. 1, 2014

(54) METHOD AND DEVICE FOR AGITATION OF TANK-STORED MATERIAL

(71) Applicant: Rineco Chemical Industries, Inc., Benton, AR (US)

(72) Inventors: John P. Whitney, El Dorado, AR (US); Carl V. Wikstrom, Benton, AR (US)

( * ) Notice: Subject to any disclaimer, the term of this patent is extended or adjusted under 35 U.S.C. 154(b) by 0 days.

(21) Appl. No.: 13/685,043

(22) Filed: Nov. 26, 2012

(65) Prior Publication Data

US 2013/0077431 A1 Mar. 28, 2013

Related U.S. Application Data

(62) Division of application No. 11/747,565, filed on May 11, 2007, now Pat. No. 8,328,409.

(60) Provisional application No. 60/799,326, filed on May 11, 2006.

(51) Int. Cl.

| | |
|---|---|
| ***B01F 5/10*** | (2006.01) |
| ***B01F 13/02*** | (2006.01) |
| *B01F 13/00* | (2006.01) |
| *B01F 3/00* | (2006.01) |
| *B01F 5/00* | (2006.01) |

(52) U.S. Cl.

CPC ..... *B01F 5/10* (2013.01); *B01F 13/0205* (2013.01); *B01F 13/0227* (2013.01); *B01F 13/004* (2013.01); *B01F 2003/0028* (2013.01); *B01F 2005/0014* (2013.01)

USPC ..... 366/136; 366/101; 366/107; 366/152.3

(58) Field of Classification Search

CPC ..... B28C 7/165; B01F 5/108; B01F 5/106; B01F 13/004; B01F 13/02; B01F 13/0205; B01F 13/0227; B01F 15/028; B01F 2003/0028; B01F 2005/0002; B01F 2005/0014; B01F 5/10

USPC ..... 366/101, 107, 136, 137, 152.3; 417/109

See application file for complete search history.

(56) References Cited

U.S. PATENT DOCUMENTS

| | | | | |
|---|---|---|---|---|
| 4,880,311 | A * | 11/1989 | Delebarre et al. | 366/101 |
| 5,253,937 | A * | 10/1993 | Scheimann et al. | 366/136 |
| 5,899,560 | A * | 5/1999 | Byers | 366/137 |
| 2004/0129319 | A1 * | 7/2004 | Scalzi et al. | 137/565.29 |

* cited by examiner

*Primary Examiner* — Timothy Cleveland
(74) *Attorney, Agent, or Firm* — McGuireWoods LLP

(57) ABSTRACT

A device and method for use with the transportation of materials including a tank that is configured to hold the material and an inlet/outlet configured on the tank to allow the flow of the material therethrough. At least one inlet is arranged on the tank to allow the flow of the material into the tank to agitate the material in the tank.

8 Claims, 8 Drawing Sheets

METHOD AND DEVICE FOR AGITATION OF TANK-STORED MATERIAL

CROSS-REFERENCE TO RELATED APPLICATIONS

This application is a division of U.S. patent application Ser. No. 11/747,565, which was filed on May 11, 2007 and which claims priority under 35 U.S.C. §119(e) to provisional U.S. Patent Application No. 60/799,326, which was filed on May 11, 2006. The disclosures of the aforementioned patent applications are expressly incorporated by reference herein in their entirety.

BACKGROUND OF THE INVENTION

1. Field of the Invention

The invention is directed to a device and method for use in the transportation and storage of materials. More particularly, to the transportation and storage of materials that have a tendency to separate during transportation such as a slurries, complex emulsions, and/or mixtures of materials that may include solid particles in a continuous phase.

2. Related Art

Many devices for transporting and storing materials need a device for agitating the materials such as large bladed mechanical agitators in order to suspend or re-suspend solids in the material. These devices are expensive, very heavy, and reduce the volume or capacity of a tank. More specifically, these current solutions use large bladed tank-mounted agitators in the tank to keep the solids in the material suspended. Unfortunately these devices add considerable weight to the tank reducing the net payload, increase the cost, and so on.

Other attempts to transport the above-noted materials have used larger volume tanks with steeply sloping conic-shaped tanks that slope to the outlet in the middle to help the solids to slide out into the outlet of the tank in a stream. Such a stream includes both phases which may become thoroughly mixed and re-suspended as the material passes through a pump. However, certain difficulties are encountered in this practice as even using a larger than normal bore hose may not always allow flow to begin from the tank to the pump as the solids tend to pile deepest in the bottom of the tank over the outlet.

Finally, users of materials, such as cement kilns, generally have physical and regulatory limits on the flow rate for unloading fuel. These limits are too low to allow high flow rates required to re-suspend the material, such as a fuel slurry, if it is simply off loaded in a single pass through the pump.

Accordingly there is a need for a method and device to re-suspend the material that is being carried or held in the tank and/or keep the material in suspension to complete the unloading of the tank without allowing significant solids to remain in the tank while not significantly adding additional weight to the tank.

SUMMARY OF THE INVENTION

The invention meets the foregoing needs and allows a device and method that suspends the material which results in a significantly better product, reduces the weight of the tank and includes other advantages apparent from the discussion herein.

Accordingly, in one aspect of the invention, to avoid leaving a substantial heel (material solids) in the tank it is necessary to mix or remix the solids and the liquids. This may be accomplished by inducing significant turbulence inside the tank prior to and preferably also during unloading. To initiate flow out of the tank may require a back flow such as a small inert gas flow to dislodge the bridged solids. Also to initiate flow with a back flow of liquids. Other specific tank designs that enhance flow include polishing the sloping floor and using a six inch diameter outlet and valve. This diameter outlet has over two and one forth times the flow area of the common four inch diameter opening.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
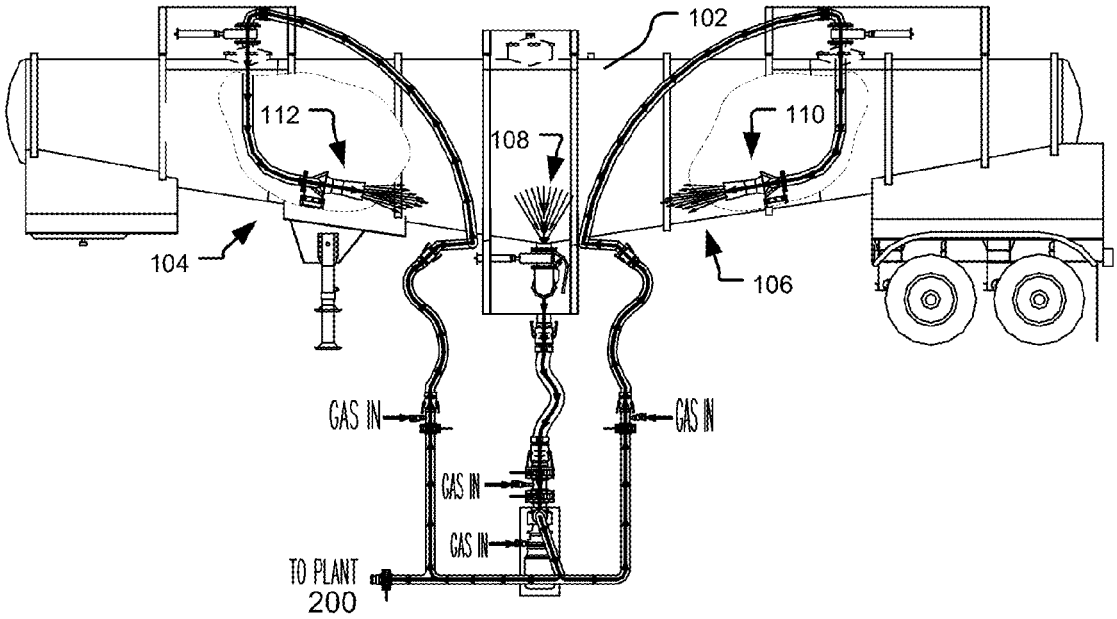
FIG. 1 shows a tank with the agitation device constructed according to the principles of the invention and configured for circulation.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

FIG. 1 shows a tank 102 that is constructed to hold various different materials. In particular, tank 102 may be constructed to carry, for example, slurry materials which are a complex emulsion and mixture of solid particles in a continuous phase that may frequently separate during transit into other materials. In particular, the tank 102 may be constructed with any known type of construction techniques. It is contemplated that the tank 102 may be constructed of aluminum or stainless steel. Moreover, tank 102 may have a conical sloping construction along the bottom to direct the material toward the center bottom of the tank 102. Additionally, tank 102 may have polished surfaces on the inside to help direct the material down toward the bottom of the tank. It should be further noted that the tank 102 shown on FIG. 1 is configured as an arrangement for a tractor-trailer. However, the invention is contemplated for use in tractor-trailers, barges, train tankers, and so on.

In order to allow the material to be removed from the tank 102 an inlet/outlet 108 is arranged somewhere on or connected to the tank 102. In particular, the inlet/outlet 108 may be arranged at a lower position on the tank 102 to allow gravity to direct the material held by tank 102 to exit from tank 102 as shown in FIG. 1.

In order to suspend or re-suspend the material, the material may be circulated. To provide circulation to the material carried in the tank 102, at least one inlet, such as inlets 110, 112, may be arranged in or on tank 102. In particular, the inlet 110, 112 may provide a flow to the material in the tank 102 to create a circulation therein and thus ensure a suspension may be maintained in the material or that the material is re-suspended within the tank 102. Although FIG. 1 shows two inlets 110, 112 any number of inlets may be arranged on or in the tank 102 to increase or provide circulation of the material that is currently being carried in tank 102.

The tank 102 further may include sloped sides 104, 106. The sloped sides 104, 106 have a tendency to guide the material toward a low point in the tank such as the point where the inlet/outlet 108 is arranged. It should be noted however, that any tank construction whether having the conical tank construction shown in FIG. 1 with sloped sides 104, 106 or having another known configuration of tank is within the scope and spirit of the invention. Next the arrangement of connections of the inlets 110, 112 and inlet/outlet 108 will be discussed.

Figure 2:
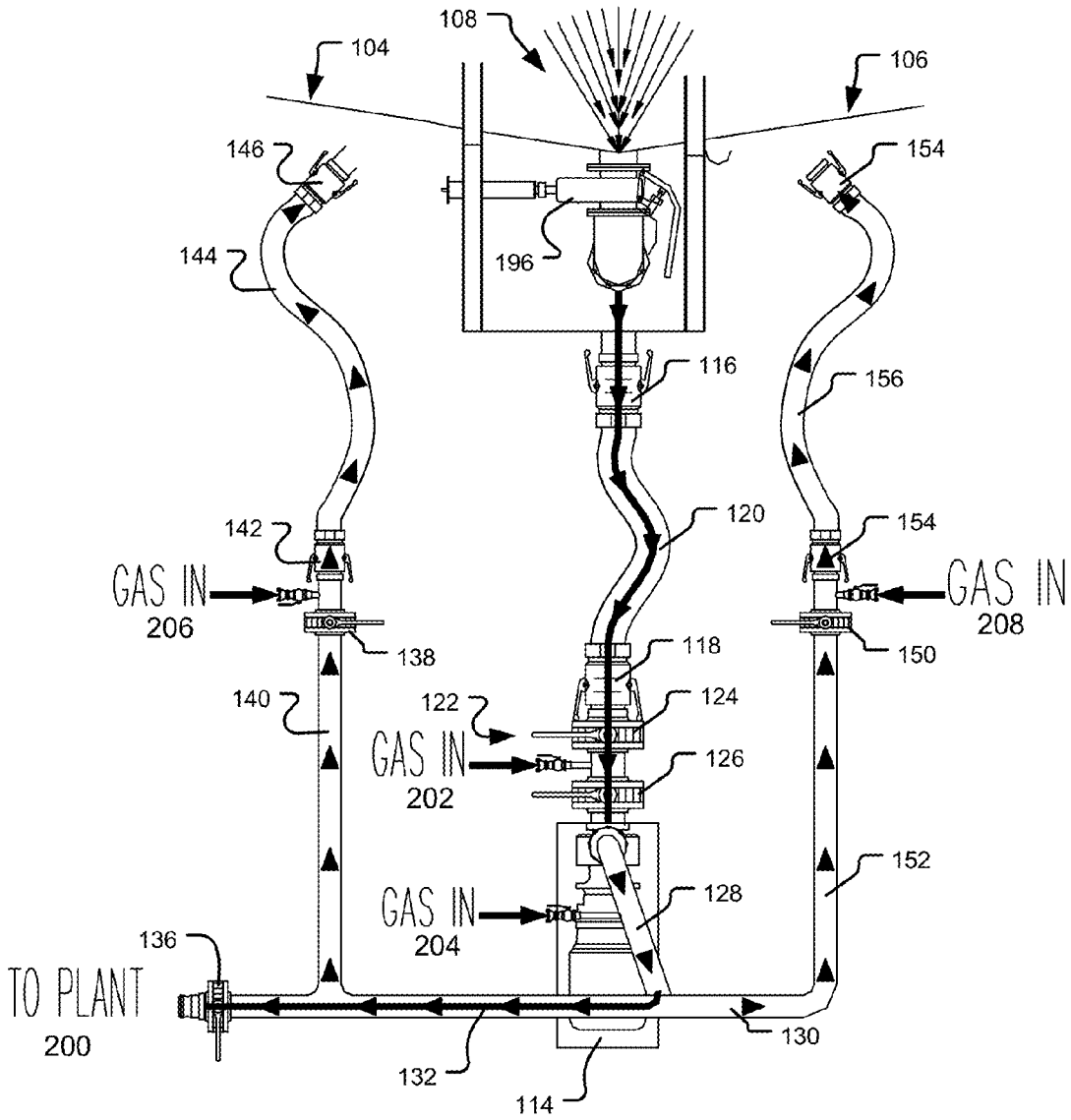
FIG. 2 shows details of a pump layout of FIG. 1 device.

FIG. 2 shows a pump layout that may be used with the FIG. 1 device constructed according to the principles of the invention. The inlet/outlet 108 may be connected to an inlet/outlet valve 196. In particular, the inlet/outlet valve 196 controls the flow through the inlet/outlet 108. The inlet/outlet valve 196 may be connected to a hose 120 through a connector 116. The hose 120 may carry the material therethrough and terminate at another end with a connector 118.

The connector 118 then connects to a manifold 122. The manifold 122 may be connected to one or more valves and a pump 114. Valve 124, 126 may be operated to stop flow between the hose and pump 114. The manifold 122 may also be connected to a valve 126 that may connect to the pump 114. The manifold 122 may further connect to a pipe 128 that may direct flow to and from pump 114. In the configuration shown in FIG. 1, valve 126 is open to allow the material in tank 102 to enter the inlet/outlet 108 through valve 196 through connector 116, hose 120, connector 118, manifold 122, valve 126 and into pump 114.

After the material has entered pump 114, as described above, the material may exit pump 114 via pipe 128. The pipe 128 may split and connect to a pipe 130 and a pipe 132. The material may then travel through pipe 132 and not travel through valve 136 which has been placed in the closed position. The material may travel through valve 138, which in the open position, and travel up through pipe 140.

Figure 3:
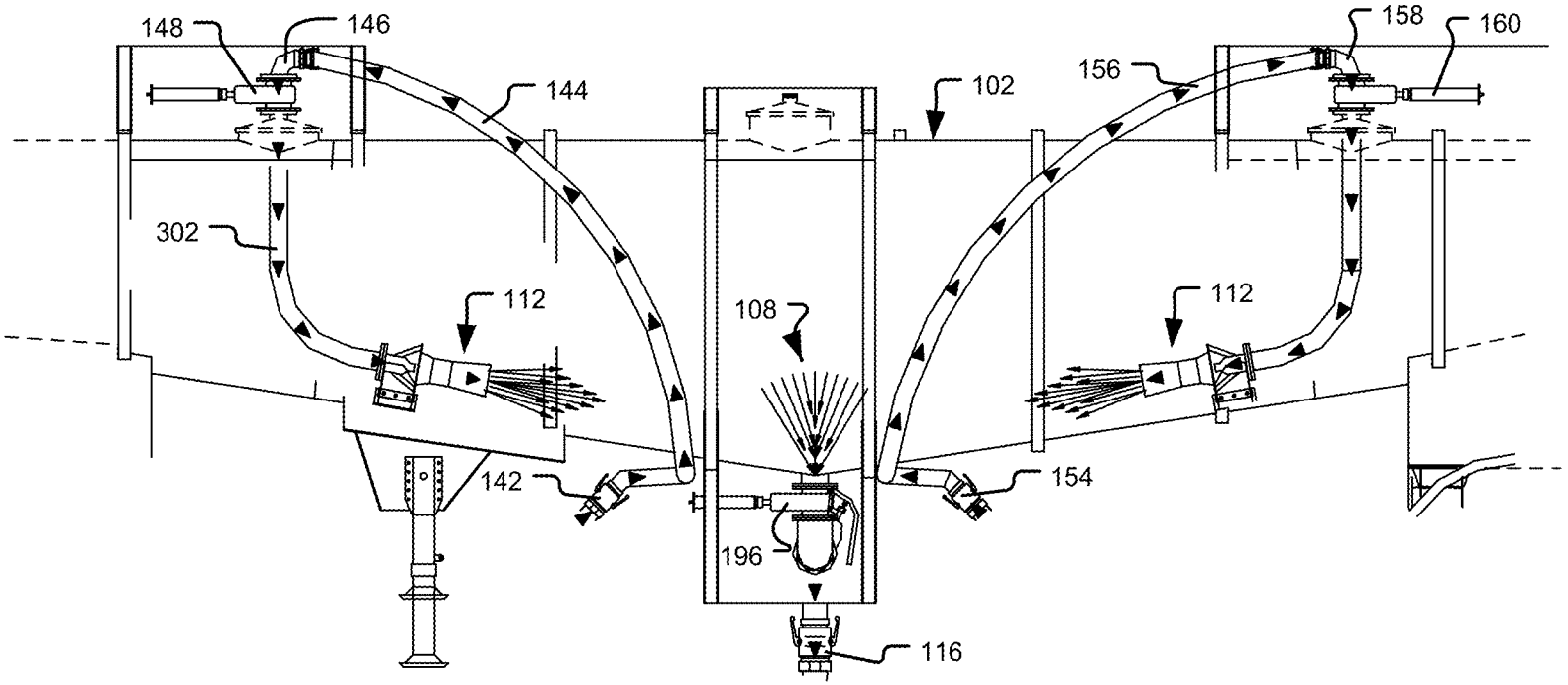
FIG. 3 shows details of the agitation device of FIG. 1.

As further shown in FIGS. 2 and 3, the material may then exit pipe 140 and go through connection 142, enter hose 144, exit hose 144 through connection 146 and may pass through valve 148, which is in the open position, to enter tank 102 through hose 302 and be ejected from the inlet 112. This will generate a circulation of material in the tank 102. The connection 146 and valve 148 may be attached in, through, or about a manway or hatch of the tank 102. This allows for a simpler manufacturing or retrofitting of the device into a tank.

The pipe 130 may also receive a flow of the material and the material may travel through pipe 130 and enter valve 150. The flow of the material may exit valve 150 enter pipe 156 and travel up to its terminal end at connector 154. A hose 156 may then carry the material to a connector 158 and past a valve 160, which is in the open position, and then into tank 102 and may be ejected through inlet 110. This further generates a circulation of the material in tank 102. Again, the connection 158 and valve 160 may be attached in, through, or about a manway or hatch of the tank 102.

Accordingly the configuration shown in FIGS. 1-3, the material enters the inlet/outlet 108 through pump 114 and may then be input back to tank 102 by at least one inlet 110, 112. Accordingly this causes a circulation of material in the tank 102 that may have a tendency to cause the material to either stay in suspension or have a tendency to re-suspend the material within tank 102.

The configuration shown in FIGS. 1-3 as described above operates to circulate the material within tank 102 to suspend the material. The same pump arrangement also may be used to direct flow of material from the tank to a plant or other facility where the material will be used. In this regard the valves 138, 150 shown in FIG. 2 may be placed in the closed position and the valve 136 may be opened to allow flow of the material exiting pump 114 to pass through valve 136 and be directed toward the plant.

The invention as further shown in FIG. 2 further includes one or more gas inlets. The gas inlets provide an ability to connect a high pressure gas source at various locations throughout the system to help assist movement of the material through one or more of the hoses, valves, and so on. For example, as shown in FIG. 2, the valve 126 may be placed in the closed position and the valve 124 in the open position. Thereafter the gas in 202 may be connected to a high pressure gas source (not shown) in which the high pressure gas source may force the contents along the pathway of connector 118, hose 120, connector 116, and valve 196 to be forced toward the tank 102. In this regard this method clears any material from these above noted areas and helps start the flow as described above.

Similarly a high pressure gas source may be connected also to the gas in 204. In this regard, valve 126 may be placed in the closed position along with valve 136 in a closed position. Valves 150, 138 may be placed in an open position. By attaching the high pressure gas source to gas in 204 the flow of material through pump 114, pipe 128, pipes 130, 132, through valves 138, and 150 may be assisted.

In the same regard, valve 138 may be closed and a high pressure gas source may be attached to gas in 206 to force a flow of material through 140, 142, 144, connector 146, valve 148 into tank 102. In substantially a similar fashion, valve 150 may be closed and a high pressure gas source may be attached to gas in 208 to assist the flow of material through connector 154, hose 156, connector 158, valve 160 and through inlet 110.

Accordingly, gas in type connections may be placed throughout the system shown in FIGS. 1-3 to help assist the movement of material through the system. Accordingly, even though a limited number of gas in type connections are shown any placement of such gas in type connections is contemplated in the invention and useable therewith.

Figure 4:
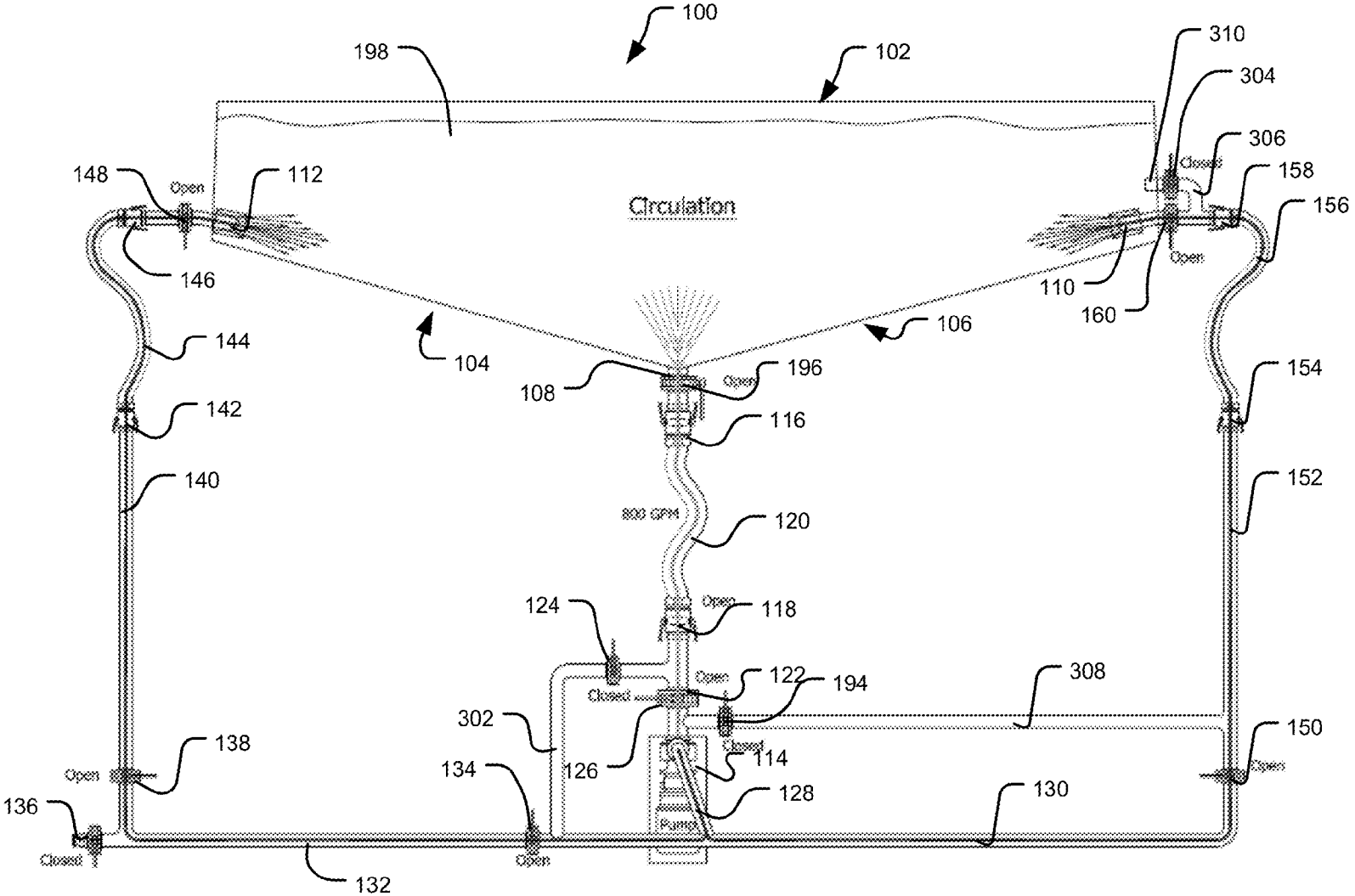
FIG. 4 shows another aspect of the device configured for delivery to a plant.
Figure 5:
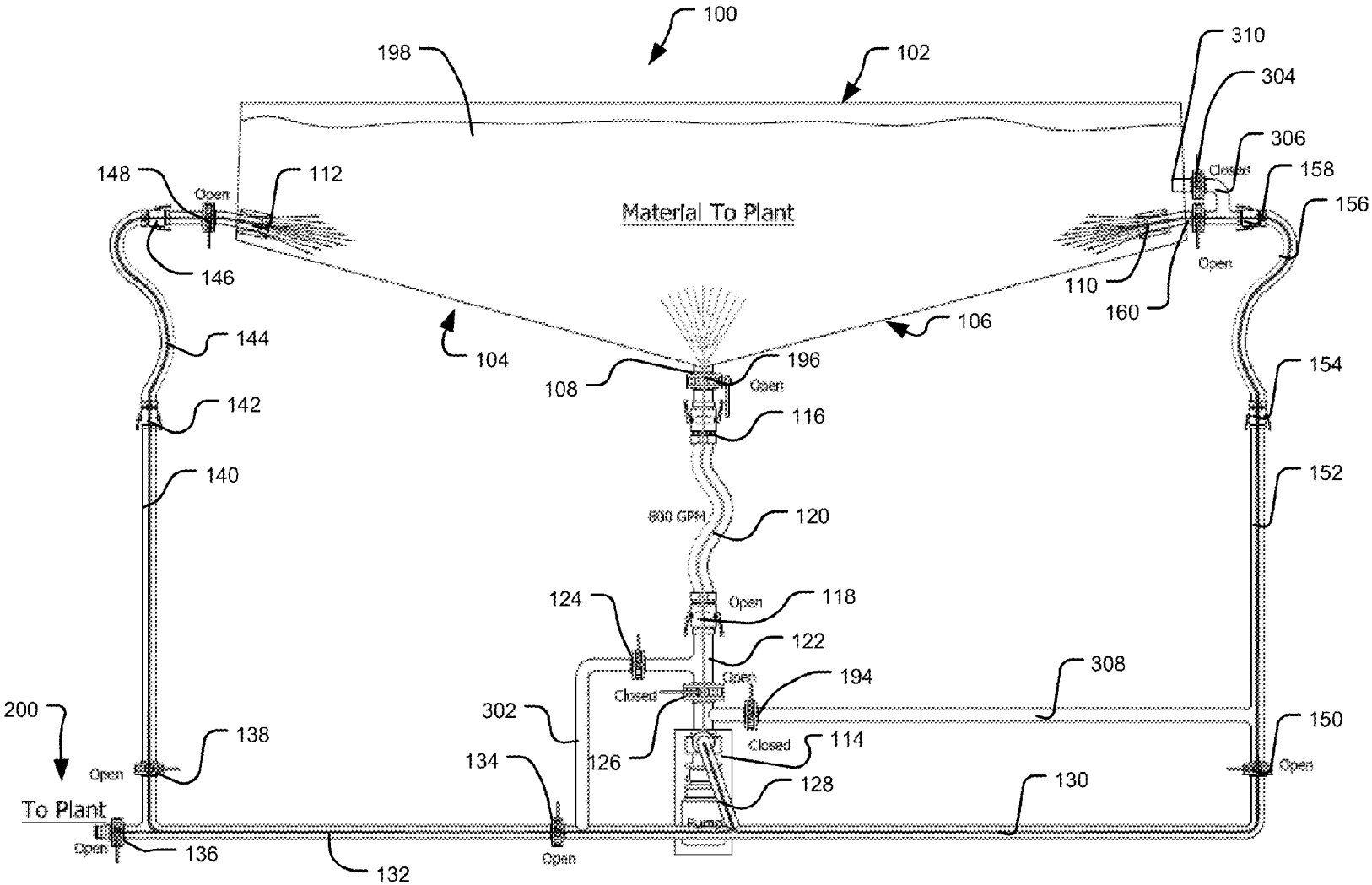
FIG. 5 shows the device of FIG. 4 configured for flow start up.
Figure 6:
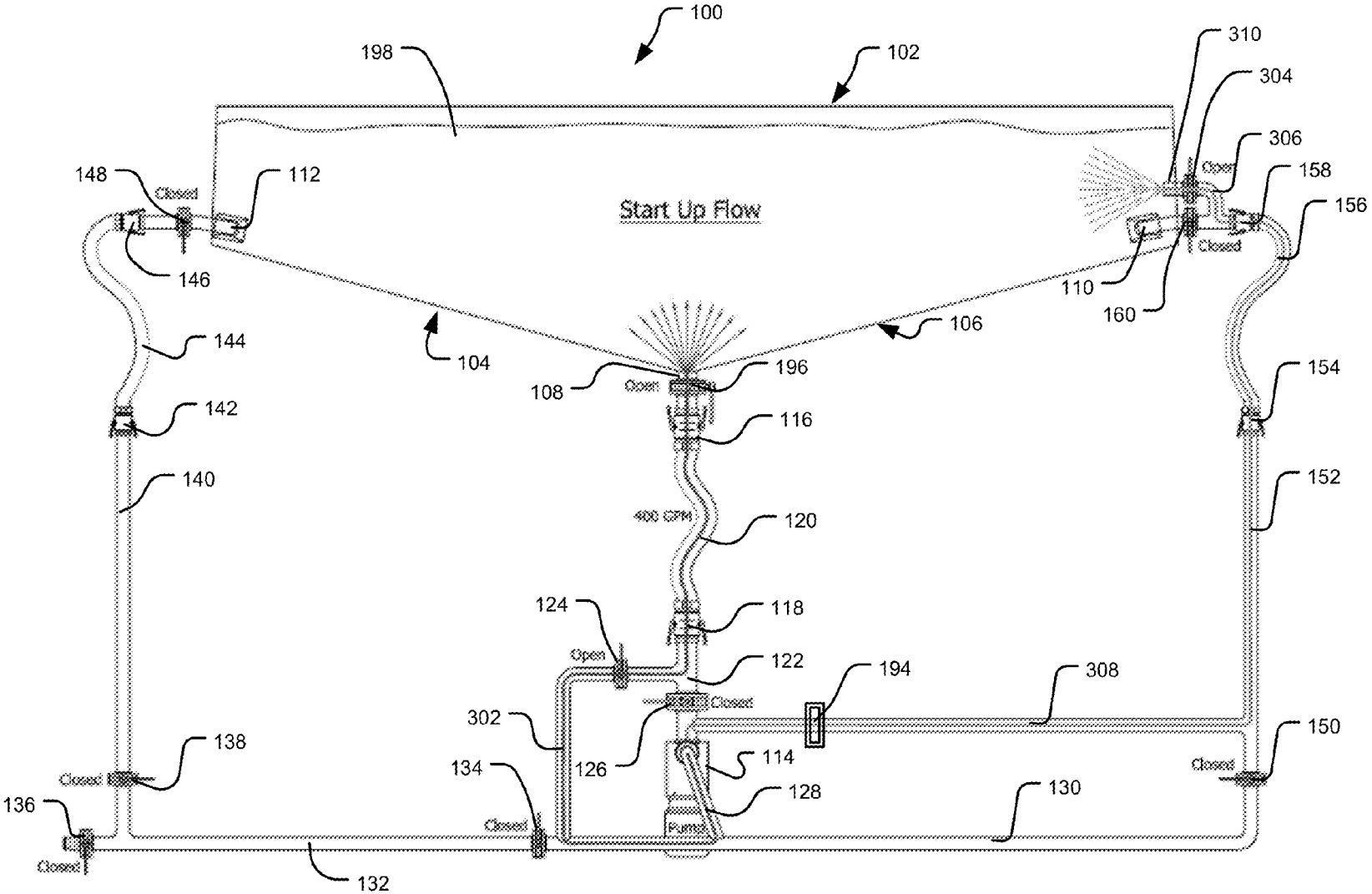
FIG. 6 shows the device of FIG. 4 configured for circulation.

FIGS. 4-6 show another aspect of the invention having similar structure and arrangement to that of FIGS. 1-3. One distinction of this aspect of the invention is that the inlets 110 and 112 are arranged such that they enter through a lower part of the tank. However, the aspect shown in FIGS. 1-3 and aspect of FIGS. 4-6 described below may be intermixed and the various features thus used as desired. The details of FIGS. 4-6 and the method of using this aspect of the invention will now be described.

FIG. 4 shows in particular the different arrangement of the manifold 122. The manifold 122 may be connected to three different valves and a pump 114. In particular, the manifold 122 may connect to a valve 124 to bypass pump 114. The manifold 122 may also be connected to a valve 126 that may connect to the pump 114. The manifold 122 may further connect to a pipe 128 may direct flow to and from pump 114. In the configuration shown in FIG. 4, the valve 124 may be closed as well as a valve 194. Moreover, valve 126 is open. This will allow the material in tank 102 to enter the inlet/outlet 108 through valve 196 through connector 116, hose 120, connector 118, manifold 122, valve 126 and into pump 114.

After the material has entered pump 114, as described above, the material may exit pump 114 via pipe 128. The pipe 128 may split and connect to a pipe 130 and a pipe 132. In particular, as the flow of the material goes through pipe 130 it may transit a valve 134. In the configuration shown in FIG. 4, the valve 134 is open and the flow of the material may continue through pipe 132. The material may then travel through pipe 132 and not travel through valve 136 which has been placed in the closed position. The material may travel through valve 138, which in the open position, and travel up through pipe 140. The material may then exit pipe 140 and go through connection 142, enter hose 144, exit hose 144 through connection 146 and may pass through valve 148, which is in the open position, to enter tank 102 through the inlet 112. This will generate a circulation of material in the tank 102.

FIG. 5 shows a configuration that is very similar to the configuration of FIG. 4. However, the FIG. 5 configuration has now been configured to allow material in tank 102 to be delivered to a plant 200 for use. Accordingly, valve 136 is now placed in the open position to allow the material held in tank 102 to be guided thereout and to the plant 200. The configuration of FIG. 5 may be used after the circulation configuration that is shown in FIG. 4 has operated for a predetermined amount of time to re-suspend or keep in suspension the material that is held in tank 102.

In some cases where a very solid heel has formed in the bottom of the tank, a self priming feature of the pump and a hose 120, valve 196 and outlet 108 may not be sufficient to start flow. To start flow by pump 114 in from one end of the tank 102. To make this possible an outlet 310 several inches below top of the tank 102 beside the inlet 110 may be utilized. From this outlet 310 by operation of the valves the hose connected to one inlet 110 may be used to accomplish reverse flow from the top of the tank into the pump 114 and by specific valving described below. In particular, the flow directed into the bottom of the tank through the normal outlet or unloading valve. This flow effectively breaks any blockage of the outlet making possible normal flow from the bottom of the tank. By resetting the valves it may be possible to pump from the bottom through the two inlets 110, 112 to circulate the material in the tank 102. After several minutes recirculation of the tank 102 the sludge that forms the heel may be eroded out by the flowing liquid and may be remixed with the fluids as the contents of the tank pass either through the inlets 10, 112 (for example, on average each 80 seconds or through the pump each 7 minutes). After adequate circulation the valve 136 is opened from one of the pump discharge lines to the unload to the plant's unload pumps as shown in FIG. 6. These pumps are boosted by the pressure from the recirculation and effect a rapid unloading while the recirculation pump maintains sufficient velocity within the tank to keep the solids from separating from the liquids.

In this regard, FIG. 6 shows the configuration of valves for the operation of the invention when there is a large amount of material buildup toward the bottom of tank 102. This buildup of material, which may be in and around the inlet/outlet 108 is known as a heel. In order to breakup the heel, the invention may be operated as shown in FIG. 6 that may include rearranging the valves to reverse the flow in the device. As shown in FIG. 6, valves 134, 150, and 126 are closed. Accordingly, the inlet 112 along with pipe 140 and 132 are not used in this configuration as shown in FIG. 6. Additionally, valve 194 is opened. This may cause the material that is exiting pump 114 to flow down pipe 128 flow along pipe 130 enter into pipe 302 through now open valve 124 flow through manifold 122, connector 118, hose 120, connector 116, open valve 196 and into tank 102 via the inlet/outlet 108. This flow up through inlet/outlet 108 may have tendency to breakup the heel which has been created in the bottom of tank 102.

The pump 114 receives the material via the now open valve 194 that receives the material along pipe 308 which is connected to pipe 152. The pipe 152 is connected through the connector 154 to the hose 156 and the connector 158 to a pipe 306. The valve 160 may be closed for this configuration. The pipe 306 is connected to a valve 304 that is an inlet 310 to the material that is arranged in tank 102. The inlet 310 may be arranged higher in the tank to avoid the heel.

Accordingly in the configuration shown in FIG. 6 the material in tank 102 may be brought in through the valve 304 then the pipe 306 and may exit through the inlet/outlet 108 to remove the heel or buildup of material at the bottom of tank 102.

In an exemplary construction of the invention including the pump 114, the invention may use either 4" or 6" butterfly valves. Moreover, the pump 114 may utilize a 230/460 326T EPFC 58 HP motor operating at 1750 rpm to operate the pump. The motor described above may be connected to the pump 114 via a class A standard flex coupling.

The pump 114 and the valves and pipe connections shown in FIGS. 1-6 may be arranged at the plant 200. In particular, when a tanker arrives at the plant 200, the pump 114 and the arrangement shown in FIGS. 1-6 may be connected to the tanker and, in particular, tank 102 of the tanker.

On the other hand, the pump 114 may be arranged on the tanker itself. This is so that the plant 200 need not have the pump arrangement as shown on FIGS. 1-6. However, it is preferable that the pump 114 and arrangement shown in FIGS. 1-6 be maintained at the plant 200 to increase the pay load and reduce the weight that the tanker has to carry.

Figure 7:
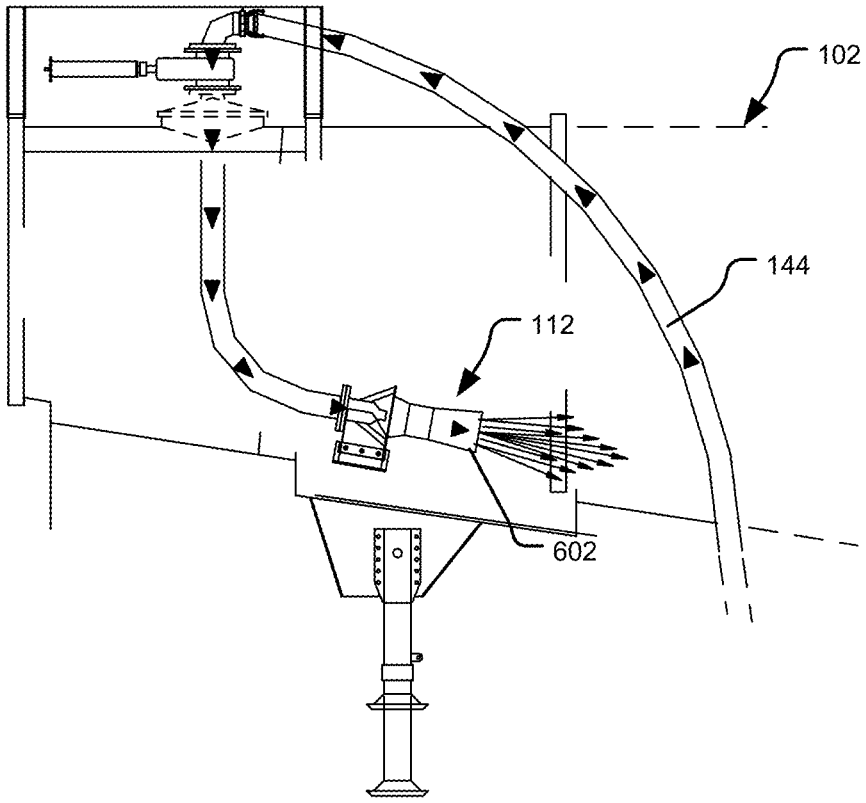
FIG. 7 shows an educator for use with the FIG. 1 device.
Figure 8:
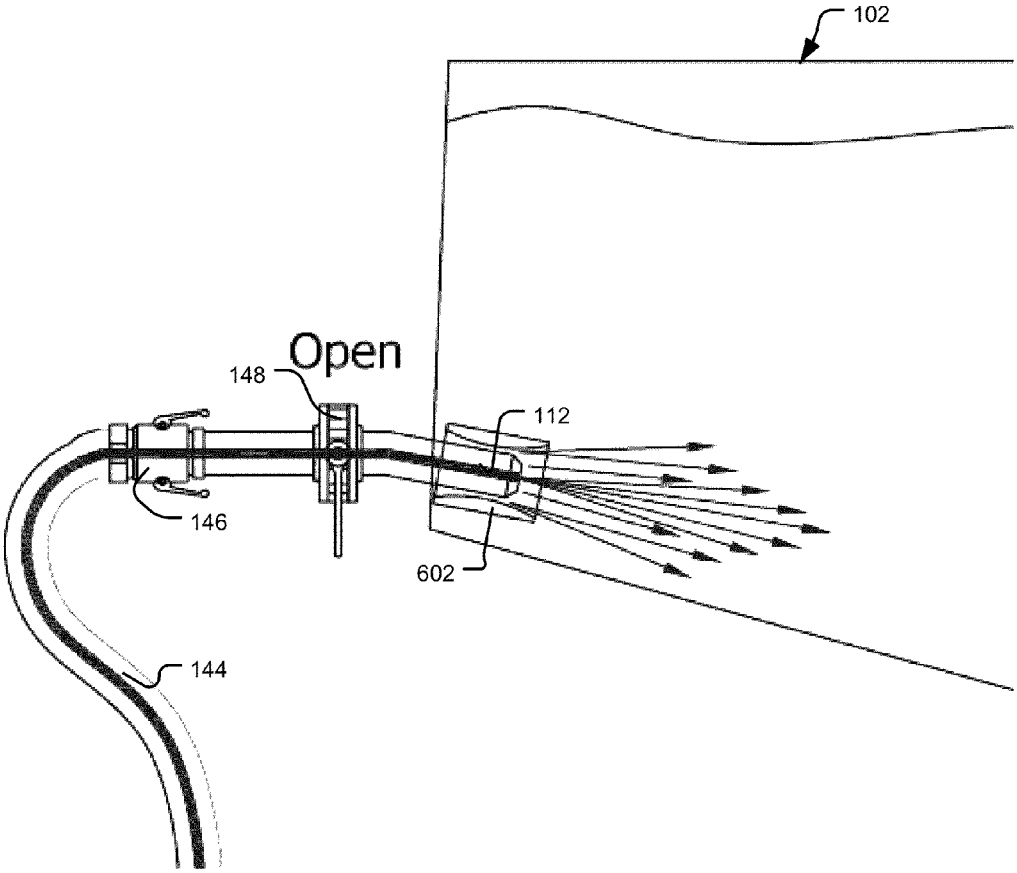
FIG. 8 shows an educator for use with the FIG. 4 device.

FIGS. 6 and 7 show a flow educator 602 that may be employed in the invention. Moreover, two tank circulating eductors may be installed in the tanker pointing down the slope 104, 106 towards the tank bottom. These eductors 602 may have a flow multiplication up to five times the flow of the motive fluid that is supplied to them. The motive fluid is supplied through the two inlets 110, 112 that preferably may be connected by hoses 144, 156 from the pump 114 as described above.

The pump 114 is preferably a self priming pump which may create a reduced pressure on the unload hose to help initiate flow. The pump 114 may also large enough to supply the eductors 602 with motive fluid while a side stream is removed to the unloading pumps of the plant 200. Such a pump 114 may be a 6 by 6 by 15 universal self priming type. The pump 114 may preferably be installed with a variable speed drive to allow a slow start-up to induce flow into the pump 114 without cavitating the pump 114. Such a pump 114 may have a flow rate of 900 gallons per minute at 45 psi. The eductors 602 require 450 gallons per minute each at a 20 psi supply pressure. This induces the full 2250 gpm circulation from each eductor.

The hose, tank, and other structures and components may be constructed of any known material that is engineered to maintain a certain amount of rigidity and moreover is able to carry the various materials therethrough. Moreover, structures and components may be in compliance with all Department of Transportation (DOT) or MIL-SPEC type material specifications and/or requirements.

As is evident by the study of FIGS. 4-6, by resetting the valves it is possible to reverse the flow of fluids into or out of the bottom of the tank. This piping and valving arrangement avoids the operators having to hook the hoses up more than once to the tank yet facilitating reverse flow if required to start flow.

The removal of the mechanical mixing equipment from the tank allows several percent more payload and allows the transport of slurry fuels with full unloading of the entire load solids and liquids.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A method for maintaining a suspension of materials in a tank, the method comprising:

connecting an inlet/outlet associated with the tank to a pump, wherein the tank contains a solid phase and a liquid phase;

connecting an inlet of a plurality of inlets associated with the tank to the pump, the plurality of inlets independently operable by opening and closing a separate valve associated with each of the plurality of inlets;

pumping at least the liquid phase from the inlet/outlet to the inlet, the pumping producing a circulation within the tank of at least the liquid phase; and connecting a high pressure gas source to the inlet/outlet;

clearing a blockage of the inlet/outlet; and maintaining the solid phase in a suspension with the liquid phase, wherein the tank is configured to hold materials, the tank comprising a bottom and sides separate and distinct from the bottom;

the inlet/outlet configured with the tank to allow a flow of the materials from the tank therethrough;

the plurality of inlets configured to direct a flow of the materials along the bottom of the tank, each of the plurality of inlets oriented substantially toward the inlet/outlet;

at least one conduit configured to direct the materials from the inlet/outlet to the plurality of inlets to agitate the materials in the tank to enhance removal of the materials from the tank; and the pump arranged to receive the materials from the inlet/outlet and transport the materials in the tank through the plurality of inlets, wherein the pump is configured to receive the materials from an outlet associated with the tank and transport the materials to the inlet/outlet through the at least one conduit.

2. The method of claim 1, further comprising re-suspending the solid phase in the liquid phase.

3. The method of claim 1, further comprising directing the suspension to a facility.

4. The method of claim 1, further comprising:

connecting the high pressure gas source to the pump; and forcing a flow from the pump to the inlet.

5. The method of claim 1, further comprising:

connecting the high pressure gas source to the inlet; and forcing a flow to the inlet.

6. The method of claim 1, wherein the bottom is further configured to be sloped, and the plurality of inlets are configured on the sides.

7. The method of claim 6, wherein the step of pumping pumps at least the liquid phase from the inlet/outlet to at least one of the plurality of inlets so that a flow is directed parallel to the sloped bottom.

8. The method of claim 1, further comprising connecting the high pressure source to separate connectors positioned between the pump and each of the plurality of inlets respectively.

* * * * *